US005479719A

United States Patent [19]

Liu

[11] Patent Number: 5,479,719

[45] Date of Patent: Jan. 2, 1996

[54] ROLLING RULER

[76] Inventor: Bao-Shen Liu, 3rd Fl., No. 20, Alley 6, Lane 190, Te Hsing E. Rd., Shin Lin District, Taipei, Taiwan

[21] Appl. No.: 339,545

[22] Filed: Nov. 15, 1994

[51] Int. Cl.[6] ..... B43L 13/02

[52] U.S. Cl. ..... 33/449; 33/491; 33/464

[58] Field of Search ..... 33/448, 449, 491, 33/492, 464

[56] References Cited

U.S. PATENT DOCUMENTS

| | | | |
|---|---|---|---|
| 2,252,311 | 8/1941 | Ware | 33/492 X |
| 4,473,228 | 10/1969 | Hortman et al. | 33/449 |
| 5,174,036 | 12/1992 | Lin | 33/449 |
| 5,193,284 | 3/1993 | Lin | 33/449 |

FOREIGN PATENT DOCUMENTS

| | | | |
|---|---|---|---|
| 1419406 | 10/1965 | France | 33/491 |
| 626014 | 7/1949 | United Kingdom | 33/449 |

*Primary Examiner*—Alvin Wirthlin
*Attorney, Agent, or Firm*—Madson & Metcalf

[57] ABSTRACT

The present rolling ruler includes a ruler body having a through hole, a shall having two ends and sleeving thereon the ruler body, and two rollers respectively mounted on the two ends for translating the ruler body. One characteristic of present invention is that different scales are provided on edges of a ruler body.

16 Claims, 6 Drawing Sheets

ROLLING RULER

FIELD OF INVENTION

The present invention relates to a ruler, and more particularly to a rolling ruler.

BACKGROUND OF THE INVENTION

Among defects of conventional rulers, a user often encounters difficulties in drawing parallel lines of different scales due to insufficient scales provided and in preventing the ink from contaminating the working sheet.

Accordingly, this invention presents a rolling ruler to solve previous time- and labor-consuming problems. The present invention is based on the recognition that if the active edge of the ruler body can be slightly risen, the ink will no more contaminate the working sheet. Further, it would be extremely convenient if different scales may be selectively used without the necessity of changing the ruler body provided with the different scales.

SUMMARY OF THE INVENTION

The object of the present invention is to provide a rolling ruler with multiple scales and/or a secondary ruler for drawing sets of horizontal and vertical parallel lines.

In accordance with the present invention, a rolling ruler comprises a ruler body having a through hole, a shaft having two ends and sleeving thereon the ruler body, and two rollers respectively mounted on the two ends for translating the ruler body.

In accordance with another aspect of the present invention, the ruler body may be generally of a triangular cross-section provided with six different scale edges. Alternatively, the cross-section of the ruler body may also be quadrangular or a cross having four pointed ends and provided with eight different scales.

In accordance with another aspect of the present invention, the surfaces of the two rollers may include an outer layer having a relatively high frictional coefficient or being roughened to be frictional for enabling the rollers to be positively controlled in motion or at a stop.

In accordance with another aspect of the present invention, the rolling ruler further comprises two shaft mountings inserted into two ends of the ruler body for respectively mounting the two shaft ends.

In accordance with another aspect of the present invention, the rolling ruler further comprises a secondary ruler movably ! held perpendicular to the rolling ruler and preferably having a triangular cross-section provided with six different scales.

In accordance with another aspect of the present invention, the rolling ruler further includes an extension device which comprises a first groove sliding therein the rolling ruler and a second groove perpendicular to the first groove and detachably attaching the to the secondary ruler. Either one of the first and the second grooves generally presents a V-shaped cross-section.

In accordance with another aspect of the present invention, the shaft of the rolling rider is rotatably mounted in the through hole or the rollers are rotatably mounted on the two shaft ends respectively.

The present invention may best be understood through the following description with reference to the accompanying drawings, in which:

DETAILED DESCRIPTION OF THE INVENTION

Figure 1:
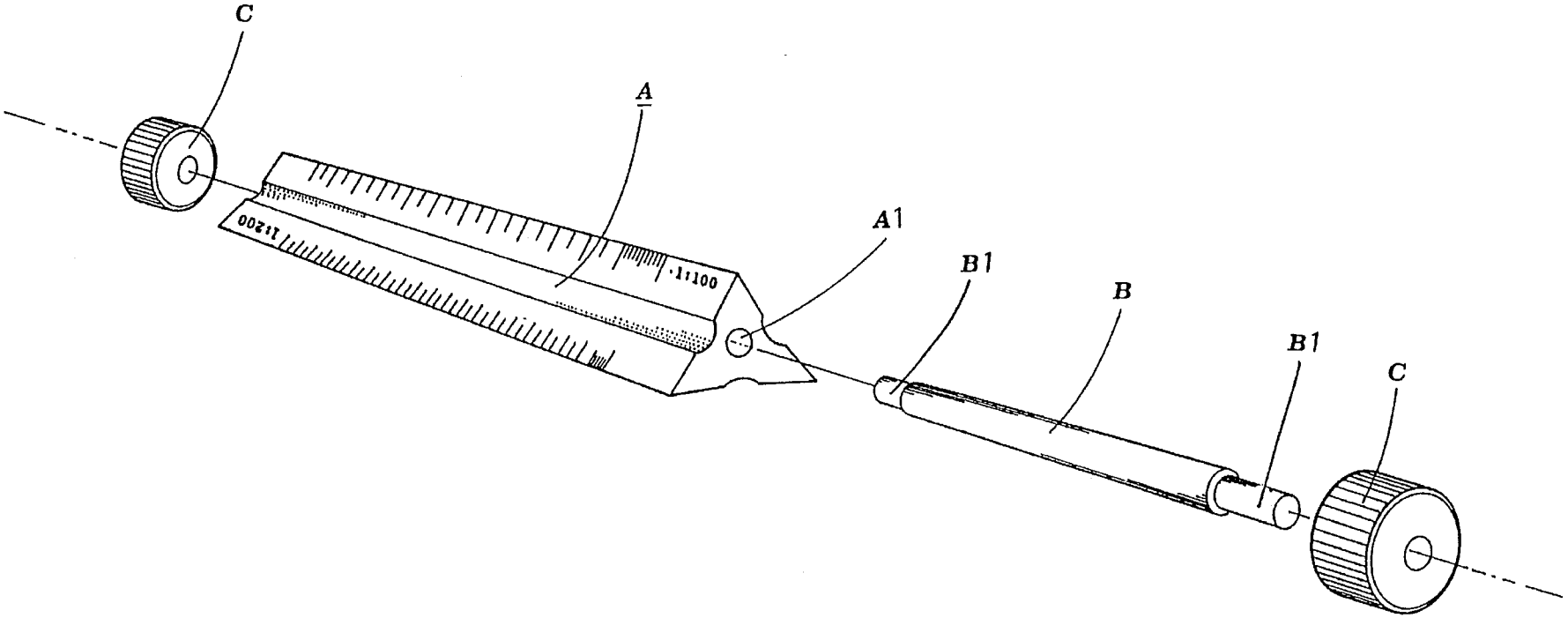
FIG. 1 is a perspective exploded view showing a preferred embodiment of a rolling ruler of the present invention.
Figure 2:
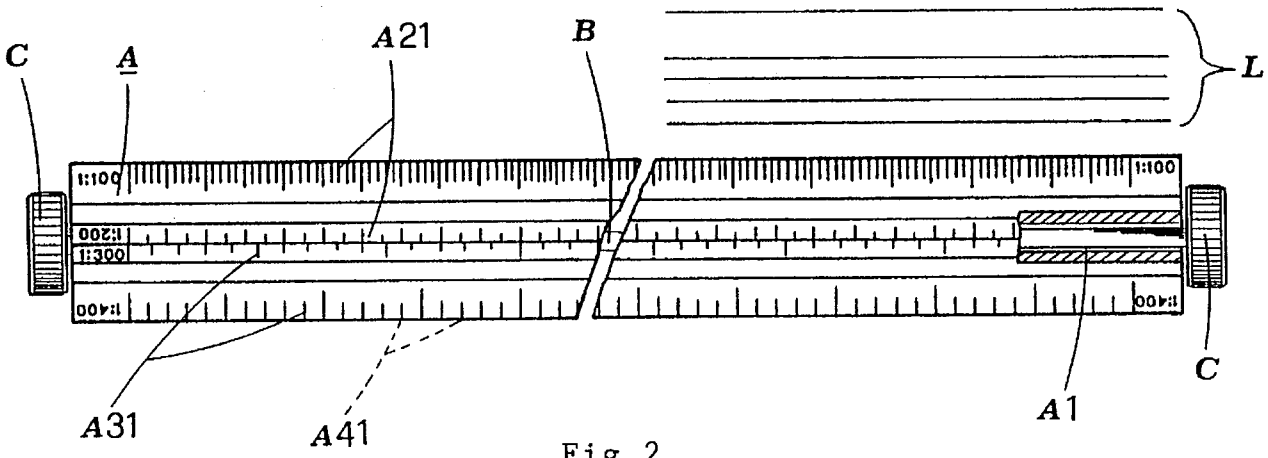
FIG. 2 is a top view showing a rolling ruler of the present invention.

Referring to FIGS. 1 and 2, a rolling ruler according to the present invention includes a ruler body A having a through hole A1, a shaft B having two ends B1 and sleeving thereon the ruler body A, and two rollers C respectively mounted on the two ends B 1 for translating ruler body A.

Figure 3:
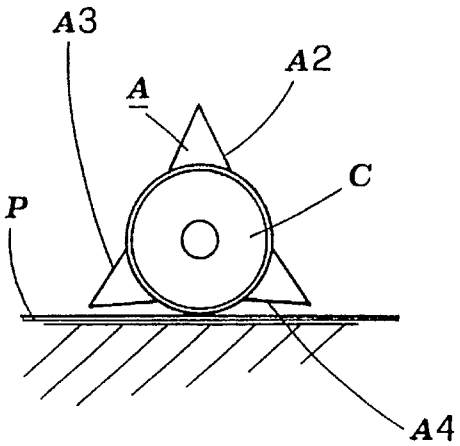
FIG. 3 is a side view showing a rolling ruler of the present invention.

Referring to FIGS. 2 and 3, the ruler body A presents a triangular cross-section and three scale surfaces A2, A3 and A4. On the two edges A5 of each of the surfaces A2, A3 and A4 are provided with two different scales A21, A31 or A41. So, a user can choose one of the scales and draw parallel lines L by moving the rightly turned ruler body A backwards or forwards.

Figure 4:
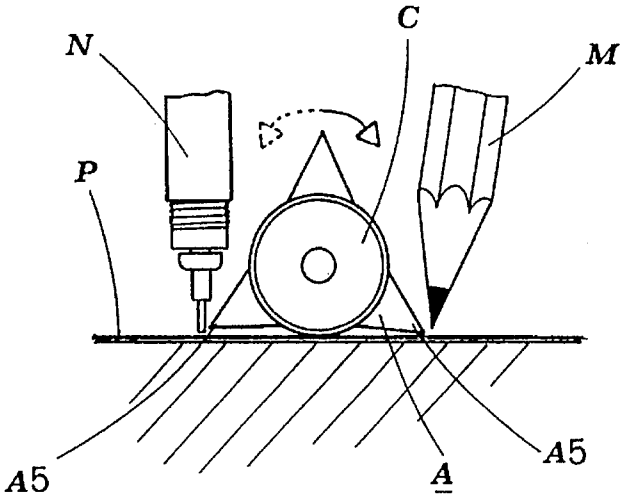
FIG. 4 is a side view showing a rolling ruler of the present invention in use.

Referring to FIG. 4, since a gap appears if a scaled edge A5 of the ruler body A is raised slightly above the working plane P upon drawing, the ink will not flow through the edge A5 to moisten or spread over the working sheet. While applying a drawing tool without ink, such as a pencil M, one can let the edge A5 of the ruler body A touch the working plane P.

Figure 5:
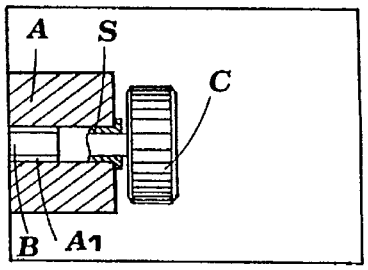
FIG. 5 is a partly sectional view showing a rolling ruler of the present invention.
Figure 6:
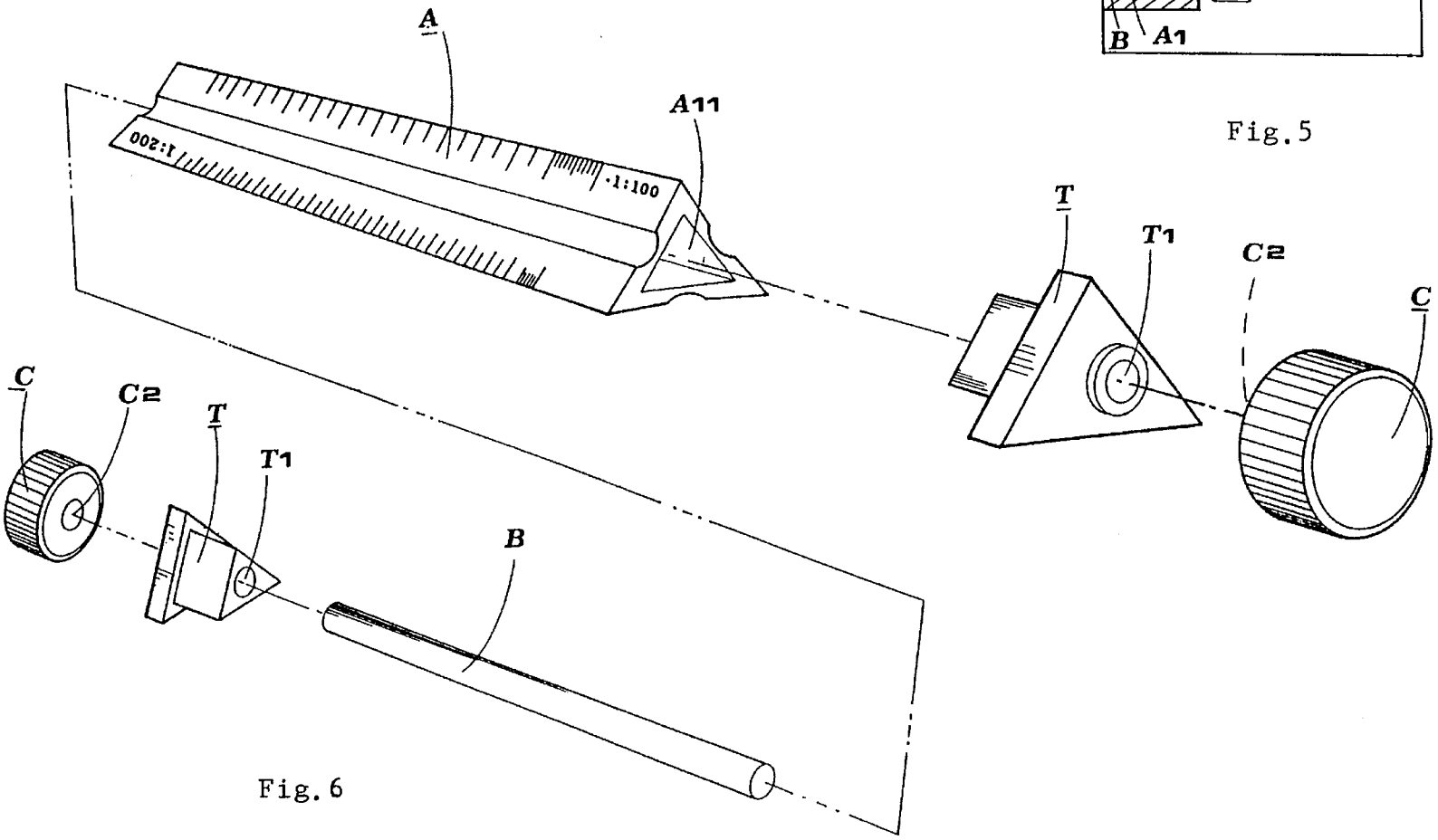
FIG. 6 is an exploded perspective „dew showing another preferred embodiment of a rolling ruler of the present invention.

Referring to FIG. 5, to decrease the friction of the shaft B mounted in the through hole A1 of the ruler body A, shaft mountings S are respectively inserted in both ends of the ruler body A in order that the shaft B is supported evenly and axially and can roll more smoothly. Referring to FIG. 6, the hollow central part A11 of the ruler body A has two shaft mountings T respectively mounted on its both ends and having two coaxial shaft holes T1 through which the shaft B can pass. Also, each of the two rollers C has a concentric hole C2 for mounting therein one of the two ends of the shaft B to decrease a rolling friction between the shaft body B and the inner surface of the ruler body A. Further, the cross-section of the shaft mountings T may be shaped corresponding to that of the hollow central part A11 of the ruler body A.

Figure 7:
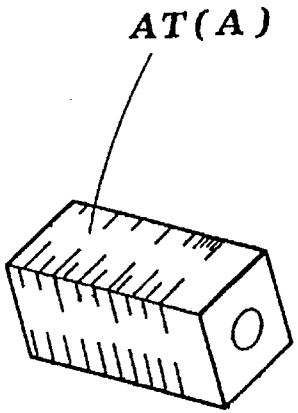
FIG. 7 is a perspective view showing a ruler body having a quadrangular cross-section for a rolling ruler according to the present invention.
Figure 7A:
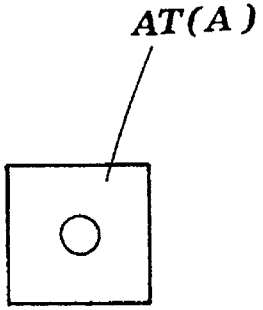
FIG. 7A is an end view showing a ruler body in FIG. 7.
Figure 8:
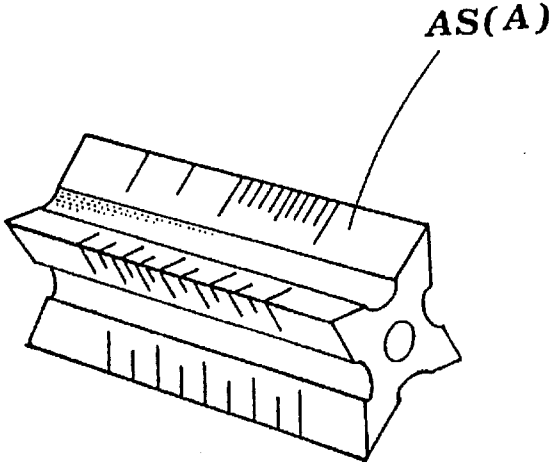
FIG. 8 is a perspective view showing a ruler body with a cross-section of a cross having four pointed ends.
Figure 8A:
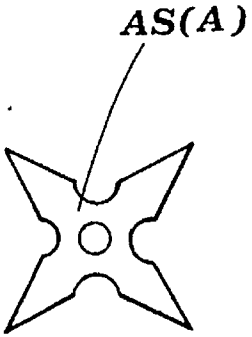
FIG. 8A is an end view showing a ruler body in FIG. 8.

Referring to FIGS. 7 and 7A, according to the present invention, the cross-section of the ruler body A may be quadrangular AT to increase different scales on its surfaces. Also, referring to FIGS. 8 and 8A, according to the present invention, the cross-section of the ruler body may be a cross AS with four points. These two embodiments are not only for preferably increasing different scales, but also for easily reading the scale and drawing lines.

Figure 9:
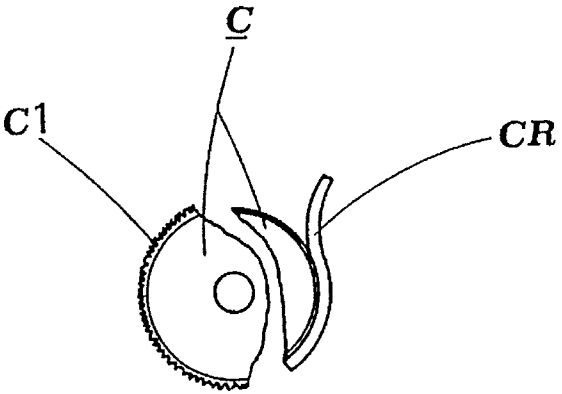
FIG. 9 is a schematic view showing the structure of a roller for a rolling ruler according to the present invention.

Referring to FIG. 9, to increase the friction of the roller C surface, it is favorable to have a roughened roller surface C1. Further, to roll over a smooth glass-plate, it is also desirable to apply a relatively high frictional coefficient outer layer CR over the roller surface C1 for enabling the rollers to be positively controlled in motion or at a stop.

Figure 10:
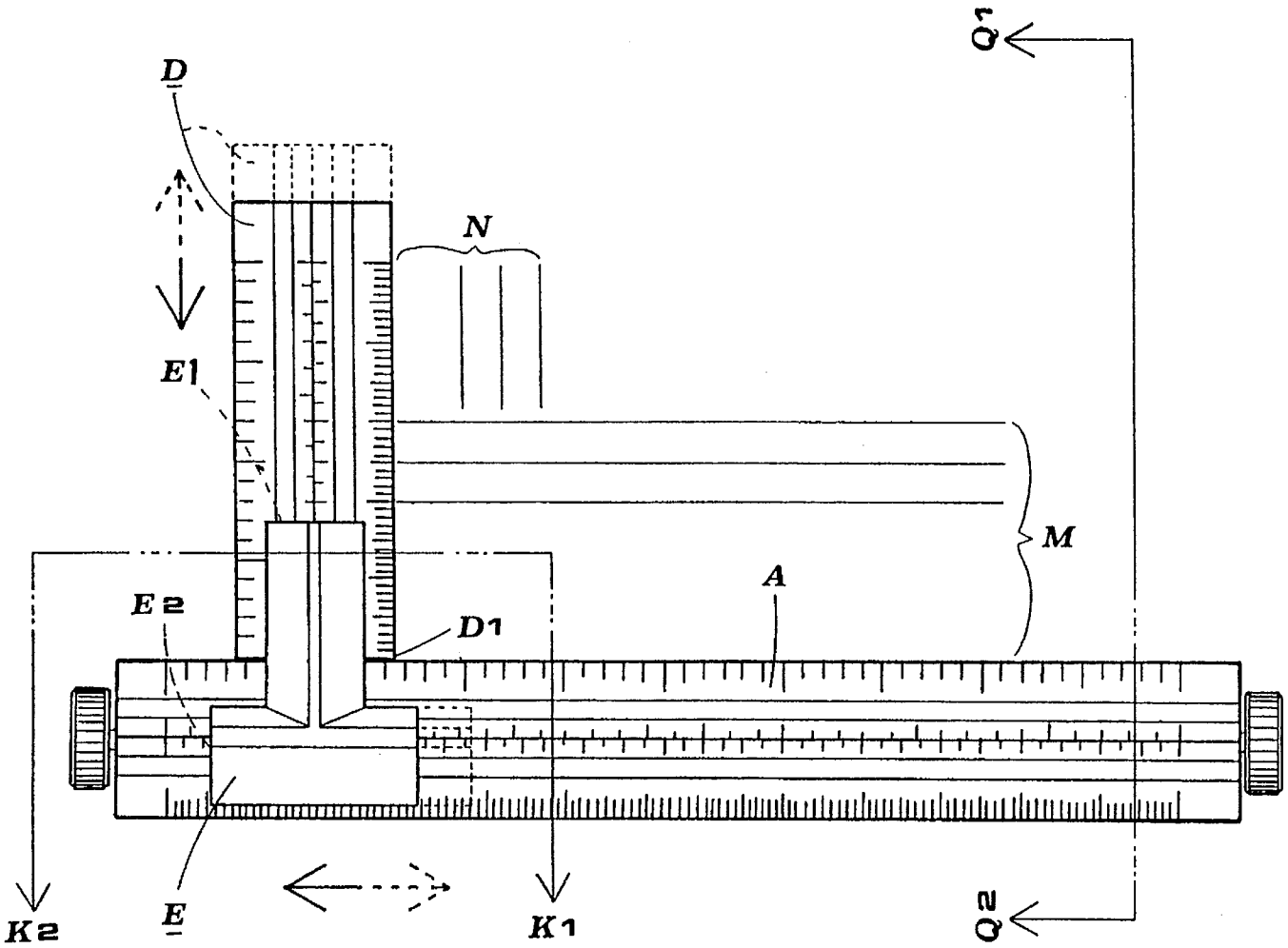
FIG. 10 is a top view showing an additional preferred embodiment of a rolling ruler according to the present invention.

Referring to FIG. 10, the rolling ruler A can further include a secondary ruler D movably held perpendicular to the rolling ruler body A and preferably having a triangular cross-section to be provided with six different scales. And either one of the first and the second grooves generally presents a V-shaped cross-section.

Figure 10B:
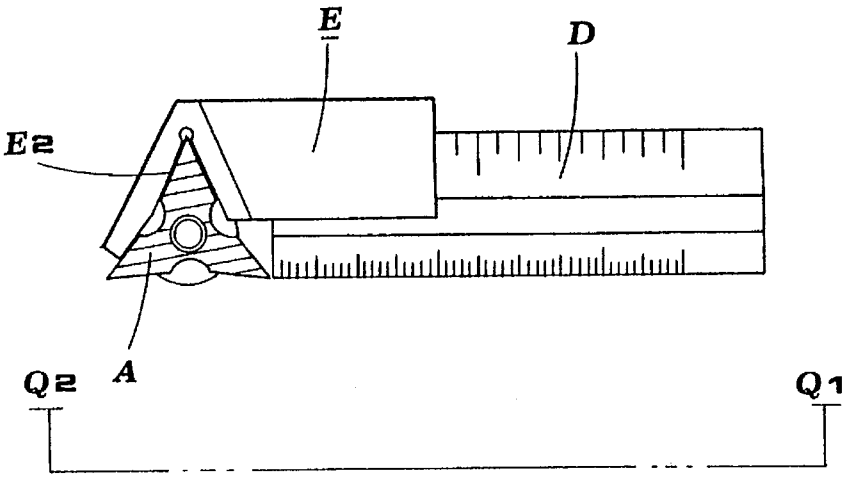
FIG. 10B is an end view showing a rolling ruler taken along line Q1–Q2 in FIG. 10.
Figure 10A:
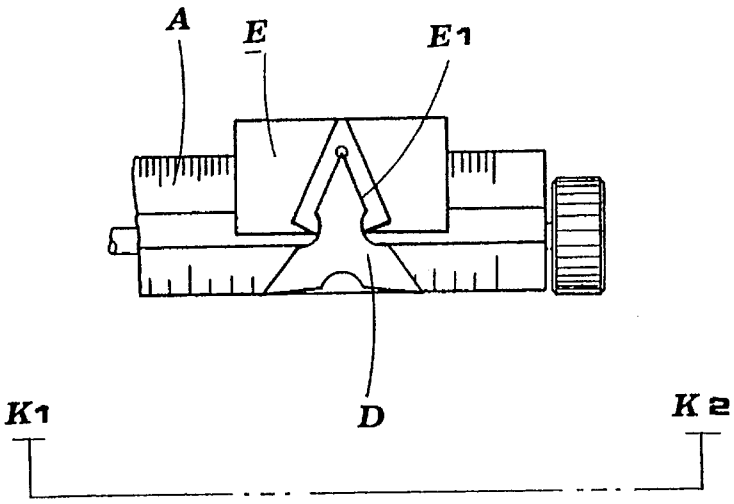
FIG. 10A is a sectional side view showing a rolling ruler taken along line K1–K2 in FIG. 10.

Referring to FIG. 10A, the ruler body A and the secondary ruler D are brought together by an extension device E which comprises a first groove E1 sliding therein the rolling ruler A, so that a horizontal displacement M can be exercised. Referring to FIG. 10B, a second groove E2 of the extension device E is perpendicular to the first groove E1 and the second ruler D can be detachably attached thereto, so that parallel lines N perpendicular to the ruler body A may be drawn. Accordingly, a horizontal displacement between the parallel lines N can be read by sliding one edge D 1 of the secondary ruler D along one relevant edge A5 of the ruler body A.

To sum up, with the ruler body A, the problem of the ink being spread over the working sheet through the ruler edge can be overcome. Further, with the rolling function of the rollers C, the secondary detachable ruler D perpendicularly attached to an extension device E and different scales provided on the ruler body A, a user can accurately and effectively draw parallel lines with distances calculated in a desired one of different scales.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What I claim is:

1. A rolling ruler comprising:

a ruler body integrally having a centrally located through hole; a plurality of surfaces on said ruler body defining an angular cross-section, the intersection of said surfaces forming a plurality of edges; a plurality of scales located on said edges; at least one scale of said scales being hidden from view when at least another scale of said scales is positioned for use;

a shaft positioned in said centrally located through hole, said shaft having two ends; and two rollers respectively mounted on said two ends, said two rollers being sized to permit translation of said ruler body when each of said at least one scale and said at least another scale is positioned for use.

2. A rolling ruler according to claim 1, wherein said ruler body is generally of a triangular cross-section having three edges.

3. A rolling ruler according to claim 2, wherein said edges of said ruler body are provided with six different scales.

4. A rolling ruler according to claim 1, wherein a cross-section of said ruler body generally is quadrangular having four edges.

5. A rolling ruler according to claim 4, wherein said edges of said ruler body are provided with eight different scales.

6. A rolling ruler according to claim 1, wherein a cross-section of said ruler body is a cross having four pointed ends.

7. A rolling ruler according to claim 6, wherein said ends of said ruler are provided with eight different scales.

8. A rolling ruler according to claim 1, wherein surfaces of said two rollers are roughened to be frictional.

9. A rolling ruler according to claim 1, wherein each of said two rollers includes an outer layer having a relatively high frictional coefficient and surrounding said each roller for enabling said roller to be positively controlled in motion or at a stop.

10. A rolling ruler according to claim 1, further comprising two shaft mountings inserted into two ends of said ruler body for respectively mounting said two shaft ends.

11. A rolling ruler according to claim 1, further comprising a secondary ruler movably held perpendicular to said ruler body.

12. A rolling ruler according to claim 11, wherein said secondary ruler has a triangular cross-section.

13. A rolling ruler according to claim 12, wherein surfaces of said secondary ruler are provided with six different scales.

14. A rolling ruler according to claim 11, further comprising an extension device which includes a first groove sliding therein said rolling ruler, and a second groove perpendicular to said first groove and detachably attaching thereto said secondary ruler.

15. A rolling ruler according to claim 14, wherein either one of said first and second grooves generally presents a V-shaped cross-section.

16. A rolling ruler according to claim 1, wherein said shaft is rotatably mounted in said through hole.

* * * * *